US010060381B2

(12) United States Patent
Zu Schweinsberg et al.

(10) Patent No.: US 10,060,381 B2
(45) Date of Patent: Aug. 28, 2018

(54) METHOD FOR DETERMINING AN OPENING DELAY OF A FUEL INJECTOR

(71) Applicant: Robert Bosch GmbH, Stuttgart (DE)

(72) Inventors: Alexander Schenck Zu Schweinsberg, Moeglingen (DE); Achim Hirchenhein, Bietigheim-Bissingen (DE); Klaus Joos, Walheim (DE); Markus Amler, Leonberg-Gebersheim (DE); Michael Bauer, Gerlingen (DE); Werner Hess, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/410,313

(22) Filed: Jan. 19, 2017

(65) Prior Publication Data

US 2017/0204804 A1 Jul. 20, 2017

(30) Foreign Application Priority Data

Jan. 20, 2016 (DE) ..... 10 2016 200 743

(51) Int. Cl.

| | |
|---|---|
| ***F02D 41/30*** | (2006.01) |
| ***F02D 41/40*** | (2006.01) |
| ***F02M 51/06*** | (2006.01) |
| ***F02D 41/26*** | (2006.01) |
| ***F02D 41/20*** | (2006.01) |

(52) U.S. Cl.

CPC ..... *F02D 41/30* (2013.01); *F02D 41/20* (2013.01); *F02D 41/26* (2013.01); *F02D 41/40* (2013.01); *F02D 41/401* (2013.01); *F02M 51/061* (2013.01); *F02D 2041/2055* (2013.01); *F02D 2041/2058* (2013.01)

(58) Field of Classification Search

CPC ..... F02D 41/401; F02D 41/20; F02D 41/26; F02D 41/30; F02D 41/40; F02M 51/061

USPC ..... 123/480, 472, 478

See application file for complete search history.

(56) References Cited

U.S. PATENT DOCUMENTS

| | | | | |
|---|---|---|---|---|
| 2012/0191327 | A1* | 7/2012 | Joos | F02D 41/20 701/105 |
| 2012/0239278 | A1* | 9/2012 | Becker | F02D 41/20 701/105 |
| 2012/0247428 | A1* | 10/2012 | Grimminger | F02D 41/2438 123/472 |
| 2014/0007847 | A1* | 1/2014 | Joos | F02D 41/2432 123/472 |
| 2015/0122000 | A1* | 5/2015 | Willimowski | F02M 51/00 73/114.45 |
| 2015/0292461 | A1* | 10/2015 | Romeo | F02M 61/1893 239/584 |

(Continued)

FOREIGN PATENT DOCUMENTS

| | | | |
|---|---|---|---|
| DE | 102008054877 | A1 | 7/2010 |
| DE | 102009002593 | A1 | 10/2010 |

*Primary Examiner* — Mahmoud Gimie

(74) *Attorney, Agent, or Firm* — Norton Rose Fulbright US LLP; Gerard Messina

(57) ABSTRACT

A method is described for determining an opening delay of a fuel injector in which by activating a solenoid with the aid of an armature, a valve needle may be opened wherein a mathematical model is used which includes an activation duration of the solenoid as an input variable and a respective opening delay as an output variable.

16 Claims, 3 Drawing Sheets

(56) References Cited

U.S. PATENT DOCUMENTS

2016/0102628 A1* 4/2016 Denk ..... F02D 41/20
701/105

* cited by examiner

METHOD FOR DETERMINING AN OPENING DELAY OF A FUEL INJECTOR

FIELD OF THE INVENTION

The present invention relates to a method for determining an opening delay of a fuel injector and a computer unit and a computer program for carrying it out.

BACKGROUND INFORMATION

Injection systems for internal combustion engines deliver fuel from the tank into the combustion chamber of the internal combustion engine. Such an injection system usually includes, beginning in the tank, a low-pressure system including a low-pressure pump, a fuel filter and lines followed by a high-pressure system including a high-pressure pump, fuel lines, distributor rails and fuel injectors which supply the fuel to the combustion chamber of the internal combustion engine as needed in terms of time and space.

With modern time-controlled injection systems, a control unit takes over the calculation of injection functions and the activation of fuel injectors and other actuators for regulating the system and the internal combustion engine.

To open, for example, a magnetic high-pressure injector of a direct injection system, a magnet is activated, i.e., energized, its magnetic force moving the valve needle out of its seat against a closing spring and an effective fuel pressure to open the injection cross section. To minimize the power demand, the armature may be secured with a so-called armature free path on the valve needle. If energized, the armature initially accelerates and then after a small lift, strikes against the valve needle. At the point in time of lift of the valve needle, a mechanical impulse is also acting in addition to the magnetic force. Therefore a maximum required amount of magnetic force may be established to be lower and the power demand may be reduced.

The influence of the needle dynamics here may be reduced for example by a mechatronic approach such as for example a so-called controlled valve operation. The activation times or activation durations of the fuel injectors are adjusted in the sense of regulation over the service life of a motor vehicle, for example, in a controlled valve operation. For this purpose, during and/or after the activation, signals are detected and from them the opening and closing points in time as well as the open duration of the valve needle are ascertained. Thus the actual open duration of each injector may be calculated and readjusted if necessary. DE 10 2009 002 593 A1 describes one such method for adjusting an actual open duration of a valve to a setpoint open duration.

One possibility for how a position and/or a speed may be determined with an electromagnetic actuator such as an armature including a solenoid, for example, is described in DE 10 2008 054 877 A1, for example.

SUMMARY

According to the present invention, a method for determining an opening delay of a fuel injector as well as a computer unit and a computer program for carrying it out are provided.

Advantageous Embodiments are the Subject Matter of the Following Description.

A method according to the present invention is used to determine an opening delay of a fuel injector in which a valve needle may be opened by activating a solenoid with the aid of an armature, in particular having an armature free path. In this case, a mathematical model is used, including an activation duration of the solenoid as an input variable and a respective opening delay as an output variable.

Use of the activation delay enables a particularly simple and rapid determination of the opening delay since, as has been found, the activation duration in fuel injectors including a solenoid, i.e., solenoid valves, has a direct influence on the opening delay. By using a suitable mathematical model into which this activation duration is incorporated, a very simple determination of the opening delay is thus possible.

A fuel injection with the aid of a fuel injector is advantageously carried out by ascertaining an open duration of the fuel injector necessary for a quantity of fuel to be introduced with the aid of the fuel injector by taking into account an activation duration of the solenoid, an opening delay and a closing delay, the opening delay being ascertained by taking into account the mathematical model. As already mentioned at the outset, a required amount of fuel may be supplied in the manner described. This may now take place more accurately due to the use of the mathematical model, whereby emission values are also improved.

The mathematical model is preferably adapted to a fuel injector in which it is to be used. A respective opening delay and/or a respective current and/or voltage profile in the solenoid is/are thus ascertained for at least one activation duration of the solenoid. This is possible since the movement of the armature and thus also the reaching of the stop on the valve needle are caused by the change in current and/or voltage profiles characteristic of the inductance of the solenoid. The mathematical model is adjusted in such a way that based on the mathematical model the respective opening delay or the respective current and/or voltage profile is obtained from at least one activation duration. This may take place advantageously by adapting parameters of the mathematical model or the mathematical equation (function) for the respective fuel injector. The formal mathematical model of a system in the form of a function is referred to as a model equation.

This model adaptation may take place, for example, with the aid of a minimal activation duration at which the valve needle just barely opens. Alternatively or additionally, information from the behavior of the fuel injector at still shorter activation durations may also be used, this information being ascertained for example from current or voltage profiles of the solenoid. In this way, a mathematical model ascertained for a certain type of fuel injector for example may be adapted or adjusted very easily to a fuel injector of this type used later in an internal combustion engine. While the general relationship between activation duration and opening delay depends only on a general design of the fuel injector, specific deviations may arise from certain manufacturing tolerances or aging phenomena to which the mathematical model may then be adapted easily, as mentioned above. An adaptation may also take place for example if the fuel viscosity is altered or if other factors influencing the movement behavior of the armature undergo changes.

For ascertaining the minimum activation duration, the activation duration is advantageously increased incrementally beginning with an activation duration at which the valve needle does not open. Then the mathematical model may be adjusted by using the activation duration at which the valve needle then opens for the first time, although only minimally, i.e., the minimum activation duration. Such an adaptation may be understood to mean, for example, the use of a correction factor or an offset.

Further, alternatively or additionally, it is preferred if the mathematical model is adapted to a fuel injector for which it is to be used by ascertaining one or multiple opening delays, taking into account a pressure profile in a respective fuel distribution system for example a high-pressure accumulator, at maximum lift of the valve needle. The maximum lift and/or full lift of the valve needle refers to a position of the valve needle in the open state in which the maximum fuel flow rate is possible. This position is usually not reached at all or is reached only briefly in the above mentioned ballistic operation but this position which may also apply for a longer period of time in other activation operations may be used specifically for adaptation of the mathematical model. For example, the opening delay may be determined from a time difference between the start of the activation and the observed pressure drop in the fuel distribution and thus a balance of the mathematical model may be achieved.

The mathematical model is advantageously ascertained by ascertaining a respective opening delay for various activation durations of the solenoid, and a relationship between the activation durations of the solenoid and the respective opening delays is then used as the mathematical model or as a determination specification.

The opening delay here indicates a time offset between the start of the activation (i.e., energization) of the fuel injector or its solenoid and the actual opening of the valve needle, i.e., unblocking of a flow-through opening for fuel. This time offset results from the period of time until a magnetic force has built up to set the armature in motion after the start of the activation, i.e., the energization of the solenoid. Furthermore, the armature also requires a certain amount of time to run through the armature free path from its resting position and to come to strike the valve needle or a stop formed thereon to open the valve needle.

Due to the inertia in buildup of the magnetic field and the components involved, there are different accelerations of the armature as a function of the activation duration in particular in the event of overall short activation durations. Since the open duration of the fuel injector is obtained from the activation duration by adding a closing delay and subtracting the opening delay, the opening delay makes a substantial contribution to the open duration. The closing delay indicates a time offset until the valve needle in fact closes after the end of the activation of the solenoid.

The mathematical model ascertained in this way is based on the physical properties of the fuel injector and enables a simple and mainly a highly accurate ascertainment or calculation of the open time for example within the scope of the controlled valve operation mentioned at the outset since the opening delay belonging to a certain activation duration may already be taken into account in advance. The relationship may be ascertained, for example, within the scope of several measurements. While the activation duration during which the solenoid is activated is predefined anyway, the opening delay corresponds to the time difference between the start of the activation and reaching the stop of the valve needle by the armature or the opening of the valve needle. The opening of the valve needle may be detected for example by a pressure drop in a respective high-pressure accumulator.

Particular advantages result precisely with very small amounts of fuel to be dispensed since, on the one hand, this requires a very short open duration of the fuel injector in which errors or inaccuracies in the opening delay have a great effect, and, on the other hand, even a so-called ballistic operation also occurs with very short open durations in which the opening delay depends to a very great extent on the activation duration since the valve needle is lifted only briefly and does not reach the stop but instead falls back into the seat after the lift.

A function, in particular, a parameterizable function which indicates the opening delay as a function of the activation duration of the solenoid is preferably ascertained or derived from the relationship between the activation durations of the solenoid and the respective opening delays and is stored as a mathematical model. The function is advantageously ascertained from corresponding relationships for several identical fuel injectors. In this way, the mathematical model which may then be used for a certain fuel injector is more accurate. When using such a function, it is then possible to ascertain very rapidly and easily the respective opening delay for an arbitrary activation duration, at least within a certain range.

The function as one or multiple characteristic maps and/or one or multiple characteristic lines is advantageously used as the mathematical model. For this purpose, the function is therefore advantageously approximated with the aid of the one or multiple characteristic maps and/or the one or multiple characteristic lines. Without using the function, certain activation durations, often required, and the respective opening delays, may be stored in pairs in characteristic maps or characteristic lines. Characteristic maps and/or characteristic lines may then be stored very easily for example in a computer unit, for example a control unit, so that the required values may be accessed very easily and quickly for ascertaining an open duration.

A dependence of the opening delay on a pressure with which a fuel for the fuel injector is supplied is preferably taken into account in the mathematical model with the aid of a dependence of the activation duration on the pressure. The pressure is for example a pressure prevailing in a high-pressure accumulator via which the fuel injector is supplied with fuel. The relationship between the opening delay and the activation duration does not per se depend on the pressure since the armature is acted upon pressure-equalized, i.e., with the same pressure from both sides in the direction of movement. The pressure therefore does not affect the movement, relevant for the opening delay, of the armature from its resting position up to the stop on the valve needle. However, at higher pressures the force required to open the valve needle, i.e., after the armature reaches the stop, is higher. This requires a longer activation duration, but this in turn also affects the opening delay. Thus the pressure may also have an indirect and minor effect on the opening delay. Thus, by taking the pressure into account, the accuracy of the mathematical model may be increased.

A computer unit according to the present invention, i.e., a control unit, in particular an engine control unit of a motor vehicle is configured in particular by programming measures to carry out a method according to the present invention.

The implementation of the method in the form of a computer program is advantageous since this results in particularly low costs, in particular when an executing control unit is also used for other tasks and is therefore present anyway. Suitable data media for supplying the computer program include in particular magnetic, optical and electrical memories such as for example hard drives, flash memories, EEPROMs, DVDs, etc. It is also possible to download a program via computer networks (internet, intranet, etc.).

Additional advantages and embodiments of the present invention are derived from the description and the accompanying drawings.

The present invention is represented schematically on the basis of one exemplary embodiment in the drawings and is described below with reference to the drawings.

DETAILED DESCRIPTION

Figure 1A:
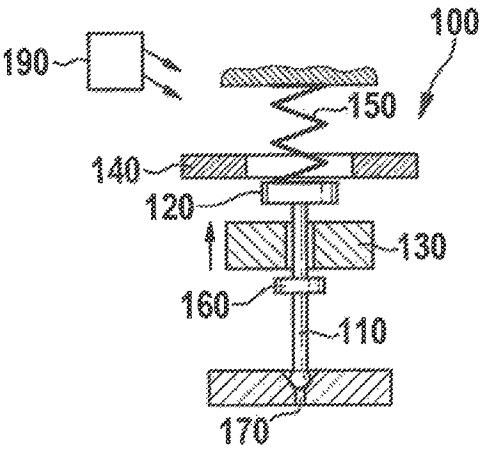
FIG. 1A schematically shows a detail of a fuel injector including a solenoid valve and an armature free path, with the aid of which a method according to the present invention may be carried out in a preferred specific embodiment in various positions during operation.

FIG. 1A schematically shows a detail of a fuel injector 100. A valve needle 110 is provided to close fuel injector 100 in a resting state so that no fuel from fuel injector 100 reaches the internal combustion engine. For this purpose, valve needle 110 closes a valve seat 170 in that valve needle 110 is acted on by a force with the aid of a closing spring 150.

In addition, in a typical fuel injector 100, a fuel pressure of a fuel which prevails in fuel injector 100 and in particular also at the top side of valve needle 110 also acts through an appropriate design in the direction of the spring force of closing spring 150.

Moreover, a solenoid 140 and an armature 130 are provided. Solenoid 140 is situated in a stationary position in fuel injector 100, while armature 130 is movable in the longitudinal direction of valve needle 110. For this purpose, a hole having a diameter slightly larger than the diameter of valve needle 110 is provided in armature 130, for example. The activation of fuel injector 100 and thus of solenoid 140 may take place with the aid of a computer unit 190, for example an engine control unit.

In the resting state armature 130 rests on a stop sleeve 160 fixedly connected to the valve needle. As soon as solenoid 140 is energized, i.e., activated, armature 130 is moved from its resting position by a magnetic force in the direction of solenoid 140, as indicated by an arrow in FIG. 1A. Armature 130 thus passes initially through a so-called armature free path.

A stop 120 is formed on valve needle 110. Stop 120 may be designed to be integral with valve needle 110, for example, or as an add-on part fixedly connected to valve needle 110. The diameter of stop 120 is larger than the diameter of the hole in armature 130. In the resting position of armature 130, a gap is provided between the upper edge of armature 130 and the lower edge of stop 120, namely the above mentioned so-called armature free path.

Figure 1B:
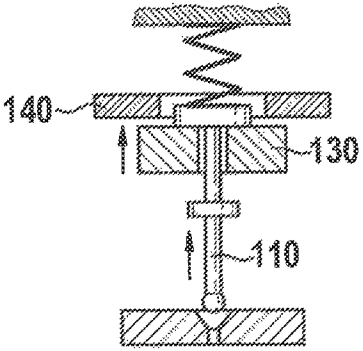
FIG. 1B schematically shows a detail of a fuel injector including a solenoid valve and an armature free path, with the aid of which a method according to the present invention may be carried out in a preferred specific embodiment in various positions during operation.

As soon as armature 130 has reached stop 120 during the activation of solenoid 140, as shown in FIG. 1B, valve needle 110 is moved together with armature 130 in the opening direction against the force of closing spring 150. This is indicated by an additional arrow at valve needle 110.

Figure 1C:
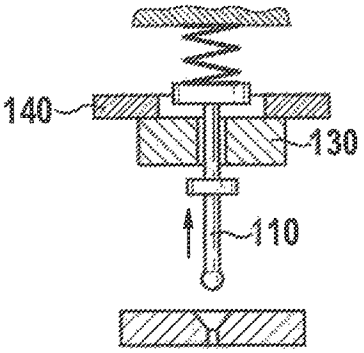
FIG. 1C schematically shows a detail of a fuel injector including a solenoid valve and an armature free path, with the aid of which a method according to the present invention may be carried out in a preferred specific embodiment in various positions during operation.

When armature 130 reaches solenoid 140 (or a housing surrounding solenoid 140 or some other stop), then armature 130 does not move further while valve needle 110 does move somewhat further upward as shown in FIG. 1C.

Figure 1D:
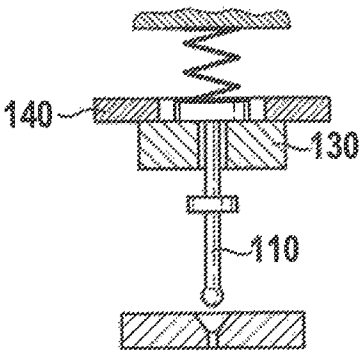
FIG. 1D schematically shows a detail of a fuel injector including a solenoid valve and an armature free path, with the aid of which a method according to the present invention may be carried out in a preferred specific embodiment in various positions during operation.

Subsequently, valve needle 110 strikes armature 130 with stop 120 after a brief movement in the closing direction, as shown in FIG. 1D. After the end of the activation of solenoid 140, armature 130 moves in the closing direction due to the now absent magnetic force. Valve needle 110 also moves in the closing direction.

Figure 1E:
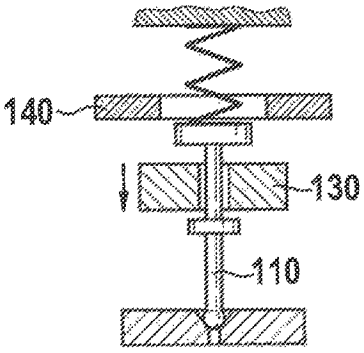
FIG. 1E schematically shows a detail of a fuel injector including a solenoid valve and an armature free path, with the aid of which a method according to the present invention may be carried out in a preferred specific embodiment in various positions during operation.
Figure 1F:
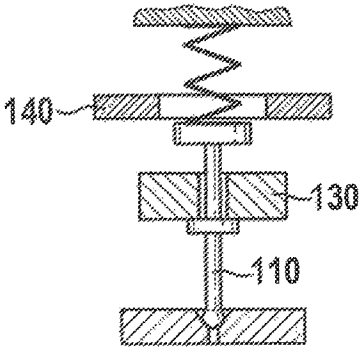
FIG. 1F schematically shows a detail of a fuel injector including a solenoid valve and an armature free path, with the aid of which a method according to the present invention may be carried out in a preferred specific embodiment in various positions during operation.

Ultimately, valve needle 110 reaches valve seat 170 and closes it, as shown in FIG. 1E. Armature 130 passes through the armature free path, as indicated by an arrow, in the direction of stop sleeve 160. Subsequently, armature 130 rests on stop sleeve 160 and is again in the resting position as shown in FIG. 1F. It is possible here that armature 130 bounces once or several times on stop sleeve 160 and is hydraulically attenuated in the process.

Figure 2:
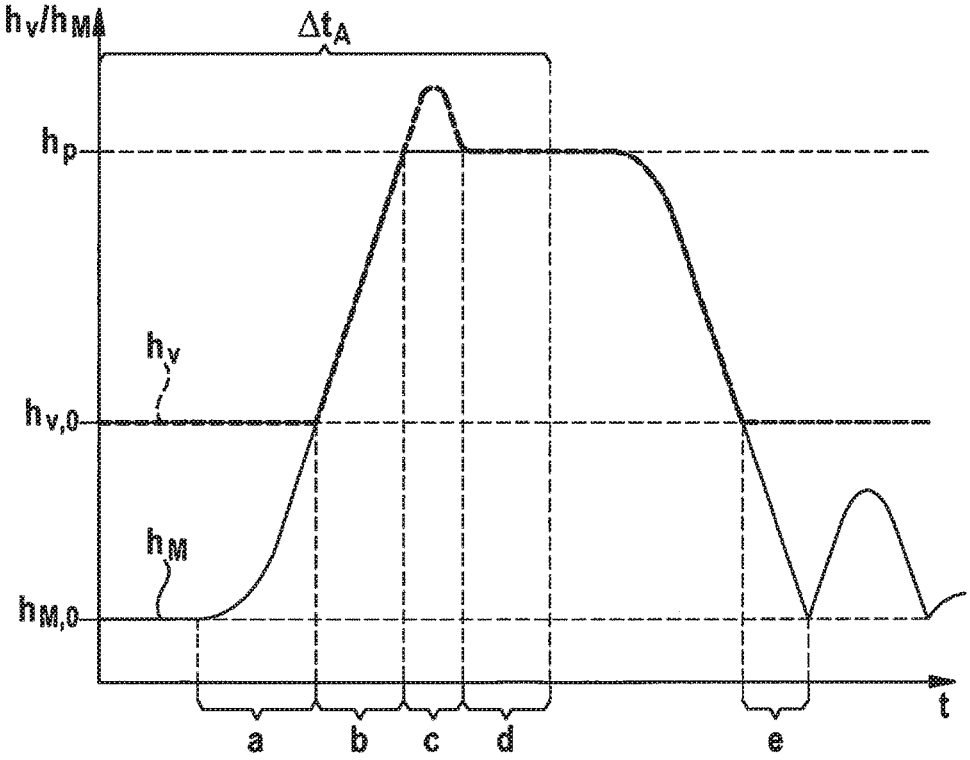
FIG. 2 shows profiles for the armature and valve needle lift in the case of a fuel injector including a solenoid valve and an armature free path, as shown in FIGS. 1A through 1F.

FIG. 2 shows the profiles of armature lift $h_M$ and valve needle lift $h_V$ in a routine injection process with passage through the positions, plotted over time t, shown in FIGS. 1A to 1F. For this purpose, reference notations a through f show time segments in which the corresponding position illustrated in FIGS. 1A through 1E is situated.

At the start of the energization or activation of solenoid 140, armature 130 moves from resting position $h_{M,0}$ in the direction of stop 120. After passing through the armature free path, armature 130 entrains valve needle 110 from the resting position $h_{V,0}$ of the stop of the valve needle in its upward movement, which results in the opening of valve needle 110 and thus the injection operation.

At the end of time segment b armature 130 reaches solenoid 140 and thus a maximum lift $h_P$. Valve needle 110 however moves somewhat further and falls back. Toward the end of time segment c, valve needle 110 reaches armature 130 and rests on it.

At the end of time segment d, the activation of solenoid 140 then ends and thus activation duration $\Delta t_A$ also ends. After a short period of time of sticking on solenoid 140, armature 130 and with it the valve needle begins to move in the closing direction. Toward the end of time segment e valve needle 110 has reached the valve seat while the armature is still bouncing.

Figure 3:
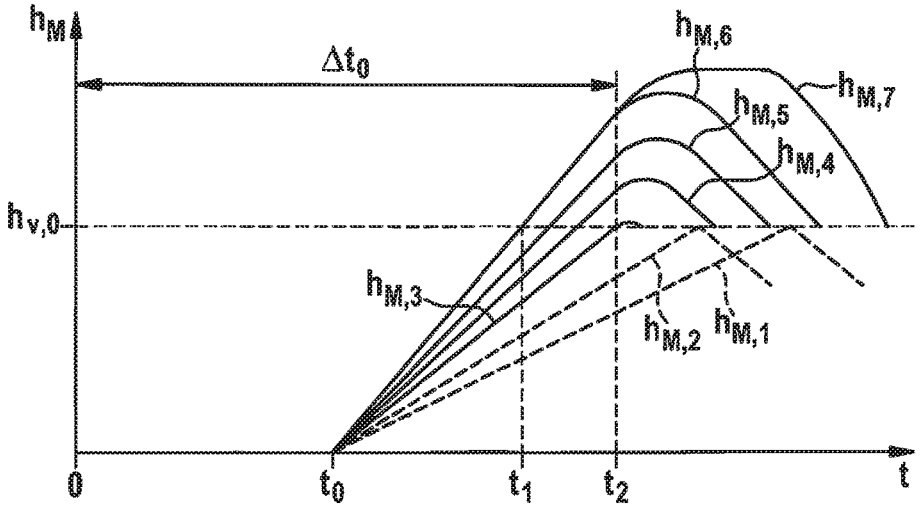
FIG. 3 shows various armature lift profiles for a fuel injector including a solenoid valve and an armature free path when a method according to the present invention is carried out.

FIG. 3 shows various armature lift profiles $h_{M,1}$ through $h_{M,7}$ as a function of time t in a fuel injector including a solenoid valve and an armature free path such as that shown in FIGS. 1A through 1F for example, in a preferred specific embodiment when a method according to the present invention is carried out.

Armature lift profiles $h_{M,1}$ through $h_{M,7}$ correspond to activation durations which always increase further beginning with index 1 up to index 7. All armature lift profiles have in common the fact that the armature begins to lift only after a certain period of time, namely here from point in time $t_0$. Before that the armature remains in its resting position (so-called "armature sticking") due to hydraulic forces.

It is apparent from armature lift profiles $h_{M,1}$ and $h_{M,2}$, that the armature has in fact reached the stop of the valve needle, i.e., resting position $h_{V,0}$ of the stop of the valve needle, but the valve needle is not yet lifted.

Only with the activation duration underlying armature lift profile $h_{M,3}$ the valve needle is opened. Point in time $t_1$ at which the valve needle opens thus defines opening delay $\Delta t_O$ belonging to the activation duration which belongs to armature lift profile $h_{M,3}$. Longer activation durations result in higher magnetic forces and shorter opening delays.

Moreover, it is apparent that the minimum opening delay, which continues up to point in time $t_2$, is reached with armature lift profile $h_{M,6}$ or the respective activation duration. No shorter opening delay is obtained with armature lift profile $h_{M,7}$ although the so-called full lift, i.e., the maximum opening of the valve needle, is already achieved here.

Figure 4:
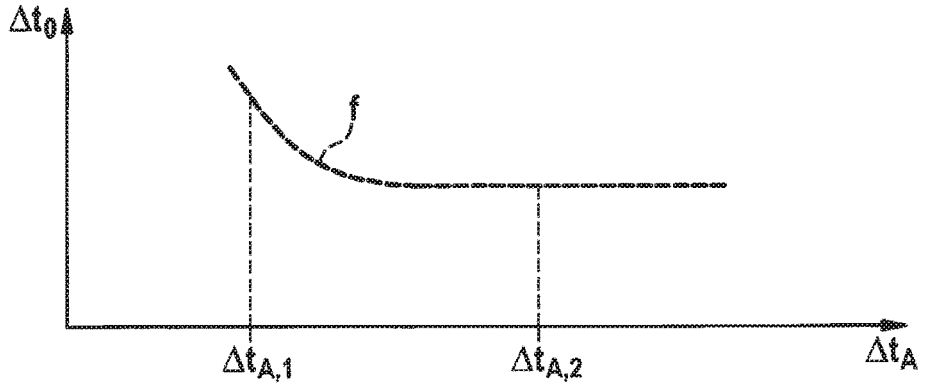
FIG. 4 shows a relationship between the opening delay and the activation duration as is ascertainable using a method according to the present invention.

FIG. 4 shows a relationship between opening delay $\Delta t_O$ and activation duration $\Delta t_A$, such as that which is ascertainable in a preferred specific embodiment with a method according to the present invention.

According to the armature lift profiles shown in FIG. 3 and their respective activation durations, respective opening delays may be ascertained, for example, for various activation durations (corresponding to various armature lift profiles). For example, this may involve the activation durations represented by armature lift profiles $h_{M,3}$ and $h_{M,2}$.

This reveals a relationship between opening delay $\Delta t_O$ and activation duration $\Delta t_A$ such as that illustrated here with the aid of the line or function f. In particular, activation duration $\Delta t_{A,1}$ belonging to time $t_1$ according to FIG. 3 is shown with the opening delay, and the activation duration $\Delta t_{A,2}$ belonging to time $t_2$ according to FIG. 3 is shown with the opening delay. While the former corresponds to the initial opening of the valve needle, the latter indicates the occurring minimal opening delay. Function f may be ascertained from individual measuring points by suitable interpolation for example.

Function f ascertained in this way may now be used as a mathematical model for ascertaining an open duration of a fuel injector, as described at the outset.

The mathematical model obtained in this way may now be adapted individually to a certain fuel injector. For this purpose, the minimum activation duration at which the valve needle opens may be ascertained for the specific fuel injector according to the armature lift profiles $h_{M,1}$ through $h_{M,3}$ shown in FIG. 3.

What is claimed is:

1. A method for determining an opening delay time of a fuel injector, comprising:

performing a fuel injection with the fuel injector by opening a valve needle, the valve needle being opened by activating a solenoid with the aid of an armature;

wherein the fuel injection is performed based on a mathematical model which includes an activation duration of the solenoid as an input to the mathematical model and an opening delay time as an output variable of the mathematical model, the opening delay time being determined as a function of the input activation duration using the mathematical model, wherein the fuel injector includes a stop of a valve needle and a stop sleeve of the valve needle, wherein the armature is movable between the stop and the stop sleeve, wherein in a resting position of the armature, there is a gap between an upper edge of the armature and a lower edge of the stop, the gap being an armature free path, and when the armature reaches the solenoid or a housing surrounding the solenoid or another stop, the armature does not move further while the valve needle does move further upward.

2. The method as recited in claim 1, wherein an open duration of the fuel injector that is necessary for an amount of fuel to be introduced with the fuel injector is ascertained by taking into account an activation duration of the solenoid, the determined opening delay time, and a closing delay time, wherein the fuel injection is performed based on the ascertained open duration.

3. The method as recited in claim 1, wherein:

the mathematical model is adapted to a fuel injector for which the mathematical model is to be used by ascertaining at least one of:

a respective opening delay time for at least one activation duration of the solenoid, a current profile in the solenoid, and a voltage profile in the solenoid, and the mathematical model is adapted so that based on the mathematical model one of the respective opening delay time, the current profile, and the voltage profile is obtained from the at least one activation duration.

4. The method as recited in claim 3, wherein the adapting of the mathematical model includes specifying a parameter of a parameterizable function.

5. The method as recited in claim 4, wherein at least one of a minimum activation duration at which the valve needle is just opening and a shorter activation duration than the minimum activation duration is used for specifying the parameter of the function.

6. The method as recited in claim 5, wherein, for ascertaining the minimum activation duration, the activation duration is increased incrementally starting with an activation duration at which the valve needle does not open.

7. The method as recited in claim 3, wherein the mathematical model is adapted by ascertaining at least one opening delay time and by taking into account at least one of the current profile and the voltage profile.

8. The method as recited in claim 3, wherein the mathematical model is adapted by ascertaining at least opening delay time and by taking into account a pressure profile in a respective fuel distribution system at a maximum lift of the valve needle.

9. The method as recited in claim 3, wherein the mathematical model is ascertained by ascertaining a respective opening delay time for various activation durations of the solenoid, and by using a relationship between the activation durations of the solenoid and the respective opening delay times as the mathematical model.

10. The method as recited in claim 9, wherein the mathematical model is a function, the function is a parameterizable function that indicates the opening delay time as a function of the activation duration of the solenoid and that is ascertained from the relationship between the activation durations of the solenoid and the respective opening delay times.

11. The method as recited in claim 10, wherein the function is ascertained from corresponding relationships for several identical fuel injectors.

12. The method as recited in claim 10, wherein at least one of at least one characteristic map and at least one characteristic line is the function.

13. The method as recited in claim 1, wherein in the mathematical model a dependence of the opening delay time on a pressure with which a fuel is supplied to the fuel injector is taken into account with a dependence of the activation duration on the pressure.

14. A computer unit for determining an opening delay time of a fuel injector, comprising:

a processor configured to perform the following:

performing a fuel injection with the fuel injector by opening a valve needle, the valve needle being opened by activating a solenoid with an armature;

wherein the fuel injection is performed based on a mathematical model which includes an activation duration of the solenoid as an input to the mathematical model and an opening delay time as an output variable of the mathematical model, the opening delay time being determined as a function of the input activation duration using the mathematical model, wherein the fuel injector includes a stop of a valve needle and a stop sleeve of the valve needle, wherein the armature is movable between the stop and the stop sleeve, wherein in a resting position of the armature, there is a gap between an upper edge of the armature and a lower edge of the stop, the gap being an armature free path, and when the armature reaches the solenoid or a housing surrounding the solenoid or another stop, the armature does not move further while the valve needle does move further upward.

15. A non-transitory computer readable medium having a computer program, which is executable by a processor, comprising:

a program code arrangement having program code for determining an opening delay time of a fuel injector, by performing the following:

performing a fuel injection with a fuel injector by opening a valve needle, the valve need being opened by activating a solenoid with an armature;

wherein the fuel injection is performed based on a mathematical model which includes an activation duration of the solenoid as in input to the mathematical model and an opening delay time as an output variable, the opening delay time being determined as a function of the input activation duration using the mathematical model, wherein the fuel injector includes a stop of a valve needle and a stop sleeve of the valve needle, wherein the armature is movable between the stop and the stop sleeve, wherein in a resting position of the armature, there is a gap between an upper edge of the armature and a lower edge of the stop, the gap being an armature free path, and when the armature reaches the solenoid or a housing surrounding the solenoid or another stop, the armature does not move further while the valve needle does move further upward.

16. The computer readable medium of claim 15, wherein an open duration of the fuel injector that is necessary for an amount of fuel to be introduced with the fuel injector is ascertained by taking into account an activation duration of the solenoid, the determined opening delay time, and a closing delay time, wherein the fuel injection is performed based on the ascertained open duration.

* * * * *